US007013493B2

(12) United States Patent
Briscoe et al.

(10) Patent No.: US 7,013,493 B2
(45) Date of Patent: Mar. 21, 2006

(54) ENTERTAINMENT VEST WITH STRAPS AND TOYS

(76) Inventors: Julie Ann Briscoe, 109 Meadow Dr., Beaver Falls, PA (US) 15010; Sandra De Ann Garner, 19670 Culpepper Cir., Parker, CO (US) 80134

( * ) Notice: Subject to any disclaimer, the term of this patent is extended or adjusted under 35 U.S.C. 154(b) by 99 days.

(21) Appl. No.: 10/835,927

(22) Filed: Apr. 29, 2004

(65) Prior Publication Data

US 2004/0221358 A1 Nov. 11, 2004

Related U.S. Application Data

(60) Provisional application No. 60/467,851, filed on May 6, 2003.

(51) Int. Cl.
*A41D 27/20* (2006.01)

(52) U.S. Cl. ..... 2/247

(58) Field of Classification Search ..... 2/69, 2/102, 108, 50, 94, 49.1, 49.2, 49.3, 48, 51, 2/75, 80, 114, 115, 247–252
See application file for complete search history.

(56) References Cited

U.S. PATENT DOCUMENTS

| | | | | |
|---|---|---|---|---|
| 1,879,341 | A | 9/1932 | Lapham | |
| 2,717,391 | A | 9/1955 | Bracken | |
| 3,931,688 | A * | 1/1976 | Owens | 40/1.5 |
| 4,068,313 | A | 1/1978 | Goldman | |
| 4,661,072 | A | 4/1987 | White | |
| 4,710,979 | A * | 12/1987 | Bull et al. | 2/48 |
| 4,723,323 | A | 2/1988 | Wright | |
| 4,985,968 | A | 1/1991 | Hooper | |
| 5,014,359 | A | 5/1991 | Hanson | |
| 5,210,881 | A * | 5/1993 | Stocker et al. | 2/247 |
| 5,247,707 | A | 9/1993 | Parker | |
| 5,394,565 | A | 3/1995 | Stewart | |
| 5,468,152 | A | 11/1995 | Lenart | |
| 5,477,560 | A | 12/1995 | Shope | |
| 5,526,535 | A | 6/1996 | Dobrzenski | |
| 5,607,452 | A | 3/1997 | Michaud | |
| 5,638,772 | A | 6/1997 | Kaufmann | |
| 5,708,978 | A | 1/1998 | Johnsrud | |
| 5,774,338 | A | 6/1998 | Wessling | |
| 5,815,834 | A * | 10/1998 | Bronson | 2/102 |
| 5,943,697 | A | 8/1999 | Poskanzer | |
| 6,105,170 | A | 8/2000 | Lisciandro | |
| 6,131,205 | A | 10/2000 | Arem | |
| 6,182,291 | B1 | 2/2001 | Garvey | |
| 6,233,739 | B1 | 5/2001 | Spence | |

(Continued)

*Primary Examiner*—Tejash Patel

(57) ABSTRACT

An article of clothing designed to also function as a traveling entertainment center, preferably for a child. The clothing may be reversible with at least one pocket, preferably eight total pockets, four on each side. Toy attachment straps can be buttoned onto each clothing front side. A hidden button system means the strap is on the outside accessible by the child, but the button attachment is on the inside of the clothing hidden under a pocket. This keeps the strap safe and secure. The bottom of each strap has a fastener loop, preferably Velcro. This strap design allows for adding and removing toys manufactured for the clothing, as well as the user's own toys, including pacifiers, rattles and rings. The fastener loop is easily opened and closed to remove and secure toys. The back of the clothing may include a flap-covered loop for attaching a child-leash system. Thus a considerably more versatile article of clothing is provided that can be converted into an entertainment center that travels with the wearer.

6 Claims, 4 Drawing Sheets

U.S. PATENT DOCUMENTS 6,442,759 B1 * 9/2002 Straham et al. ..... 2/49.1
6,449,815 B1 9/2002 Spiller
6,606,768 B1 8/2003 Henry
6,684,422 B1 2/2004 LeFevre

* cited by examiner

Perspective view of the vest version taken from the front side.

ENTERTAINMENT VEST WITH STRAPS AND TOYS

CROSS REFERENCE TO RELATED APPLICATIONS

This application claims the benefit of U.S. Provisional Application No. 60/467,851, filed May 6, 2003.

FEDERALLY SPONSORED RESEARCH

None

SEQUENCE LISTING

None

BACKGROUND OF THE INVENTION

This invention relates to the field of apparel to cover a person's body, or more specifically of a child's vest for the attachment and securing of toys and other child items.

Traveling with a child or infant often requires that the parent or guardian also bring a variety of other items to either care for or entertain the child or infant such as rattles, small toys, and pacifiers. Oftentimes, children in strollers or car seats will play with a toy or pacifier, then suddenly drop or throw the item to the ground or floor without warning to the dismay of their caretakers. The item dropped or thrown may then become dirty or otherwise rendered unusable, if not lost altogether. Parents and guardians of small children would greatly benefit from a clothing garment already worn by the child that allowed for the attachment and containment of these items, keeping the items clean, useable, and always at hand for the child.

Conventional clothing garments for children or infants cannot solve this problem because they lack the ability to suitably combine storage and containment of these items. One previous patent in particular comes close to achieving these desired results. In U.S. Pat. No. 4,068,313 to Goldman, a children's bib is claimed with a permanently attached toy on a removable cord. However, Goldman's patent does not solve the problem of being able to detach the toy or other object from the cord for easy cleaning and interchangeability of items. Also, Goldman's patent does not include the addition of pockets onto the item of clothing in order to provide sufficient storage and containment of the items when not immediately in use. Additionally, while other clothing articles exist to provide for storage and containment of child items, U.S. Pat. No. 6,105,170 to Lisciandro, these clothing articles are meant to be worn by the parent or guardian, and do not solve the problem of what happens after the child drops or throws the item.

The existence of vests or other clothing garments for use as storage and containment devices is widely seen in the areas of fishing and hunting garments. Several United States Patents which describe these vests include U.S. Pat. No. 1,879,341 to Lapham, U.S. Pat. No. 5,247,707 to Parker et al., U.S. Pat. No. 5,014,359 to Hanson, U.S. Pat. No. to 2,717,391 to Bracken, U.S. Pat. No. 5,526,535 to Dobrzenski, and U.S. Pat. No. 6,182,291 to Garvey. These fishing and hunting vests allow for a wide variety of storage and retractability uses, but are not meant to meet the needs of children or infants. Similar vests and clothing garments are seen to house electronics (U.S. Pat. No. 5,774,338 to Wessling III), medical equipment (Johnsrud in U.S. Pat. No. 5,708,978), and even golfing equipment (U.S. Pat. No. 6,233,739 to Spence), but none specifically address the problem of a child dropping or throwing small toys.

Rather, this invention is a result of the unique combination of the prior related art to arrive at a functional item of child's clothing that would allow for the temporary and interchangeable attachment of entertainment or pacifying items onto the clothing apparel while also including pockets for storage and containment when the items are not in use.

SUMMARY

This invention relates to a child's article of clothing, specifically an article of clothing which allows toys and other items to be fastened to it to function as a traveling entertainment center. This invention would allow a child to wear this clothing and allow the child to play with multiple toy items attached to the clothing in any setting or environment. This invention allows the user to take the clothing anywhere and keep a child entertained by adding and removing the straps and toys at anytime. Because the toys are attached to the clothing, they are contained, easily accessible by users, and kept clean.

REFERENCE NUMBERS

Figure 1:
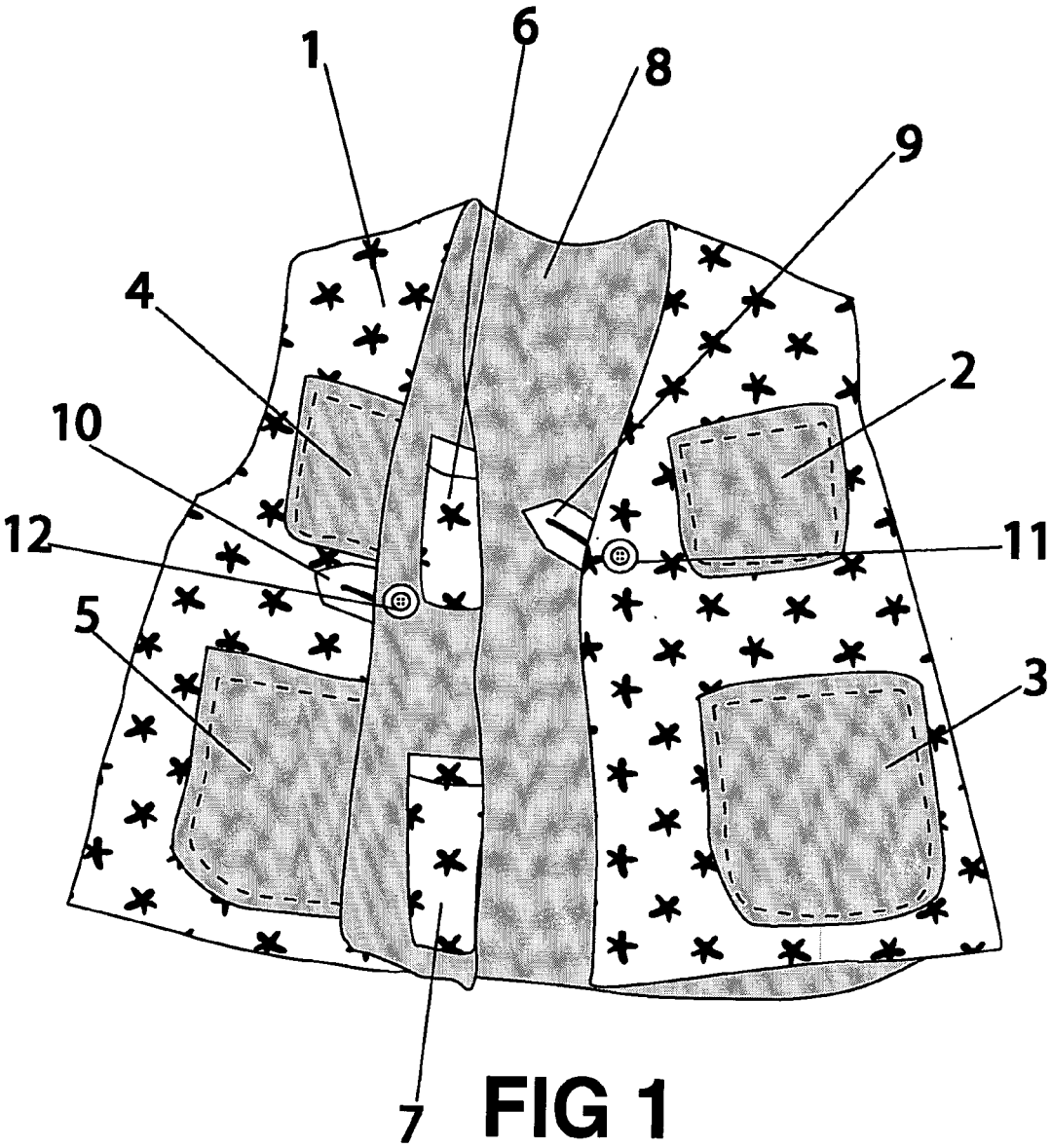
FIG. 1 is a perspective view of the vest version of clothing taken from the front side of the vest. The vest is reversible, and both sides have four pockets (2, 3, 4, 5, 6, and 7). Six of the eight pockets are visible. Each side of the vest has a loop (9 and 10) to loop around the button (11 and 12) on the opposite side to close the vest. Only one loop and button are used at a time to close the vest.

1. Side one of the reversible clothing
2. Side one small, upper pocket (right side)
3. Side one larger, lower pocket (right side)
4. Side one smaller upper pocket (left side)
5. Side one larger, lower pocket (left side)
6. Side two, smaller upper pocket (left side)
7. Side two larger, lower pocket (left side)
8. Side two of the reversible clothing
9. Button loop to secure clothing, right side
10. Button loop to secure clothing, left side
11. Button to close clothing, right side
12. Button to close clothing, left side
13. Button fed through clothing from side two
14. Toy strap
15. Toy used with clothing strap
16. Loop on toy
17. Fastening closure portion of toy strap
18. Button hole hidden beneath pocket, one of 8
19. Back side of the clothing
20. Flap to cover leash hook
21. Leash hook

DETAILED DESCRIPTION

This application claims the benefit of U.S. Provisional Application No. 60/467,851, filed May 6, 2003.

In operation, one uses the Entertainment Clothing with Straps & Toys to function as an article of clothing. However, the user can turn the article of clothing into a traveling entertainment center by adding or removing the vest straps with the toy attachments.

The clothing may be reversible and has at least one pocket on each front side (FIG. 1).

The clothing is closed (FIG. 1) by sliding a loop onto a button (FIG. 1). There is a button (11 and 12) and a loop (9 and 10) on each side of the clothing, so both sides of the reversible version of the clothing can be closed.

Figure 2:
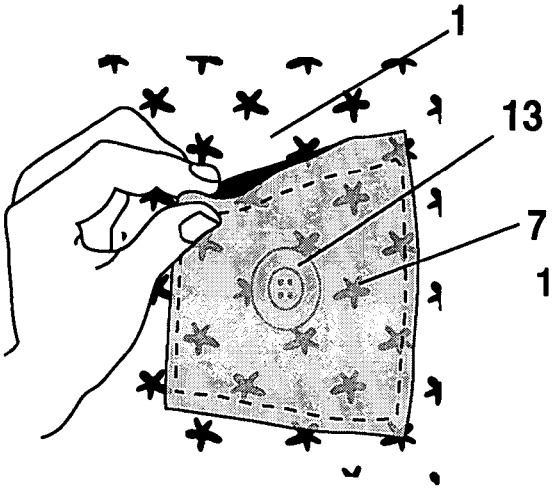
FIG. 2 is a perspective view of the vest version of clothing taken from inside a pocket (7), specifically a button, on the inside of the vest, used to secure the strap onto the reverse side of the vest. (13)
Figure 3:
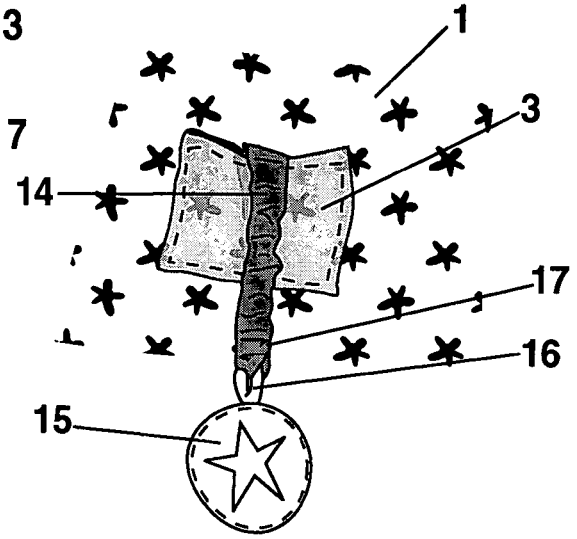
FIG. 3 is a perspective of the vest version of clothing of a portion of the front of a vest with a toy strap attached. The top of the strap is not visible because it is buttoned onto the vest and the button is on the reverse side of the vest. The bottom of the strap (17) shows the fastener loop used to add and remove vest toys. A sample toy is shown (15). The top of the sample toy (15) has a loop (16) that slides onto the portion of the strap that is fastened (17) to keep the toy attached.
Figure 4:
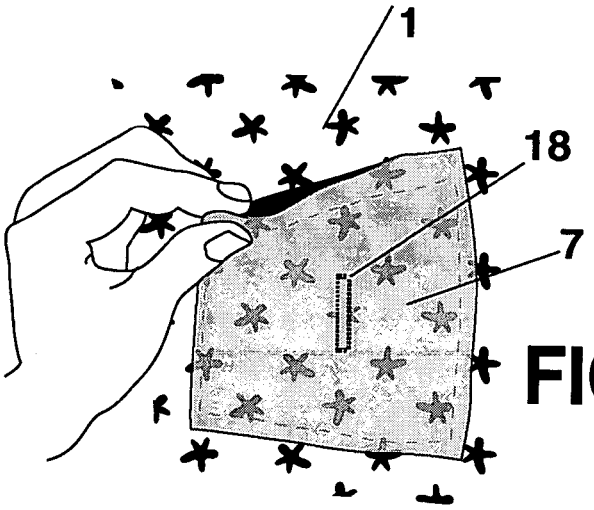
FIG. 4 is a perspective view of the vest version of clothing taken from inside a pocket (7), specifically a button hole used to attach the top (13) of the toy strap to the vest. This view is shown to demonstrate how a vest pocket appears without a strap attached.

One each toy strap for each pocket may be buttoned onto the front of the vest by securing beneath each pocket (FIG. 1 and 3). The button hole system keeps the straps attached and away from small hands (FIG. 2). The button on the upper part of the strap fits into the button hole hidden (FIG. 4) behind any of the pockets on the front of the vest. This means the strap is on the outside accessible by the wearer, while the button is hidden on the inside. There are button holes; each for the opposite pair of each pocket. In the reversible clothing version, each button hole provides an opening shared by two pockets. For example, pockets 5 and 7 share the same button hole. This allows the strap to be buttoned on from either side and hidden in the pocket.

The bottom of each strap has a fastening loop. (FIGS. 5, 6 and 7) This design allows for adding and removing toys manufactured for the clothing, as well as the user's own toys, including pacifiers, rattles and rings. The fastener is easily opened and closed to remove and secure toys.

The toy straps (FIG. 6) are cloth-covered elastic, allowing them to be stretched. Some straps may also contain sound-making items, such as shrink-wrap material and bells. This adds to the entertainment of the child.

Figure 5:
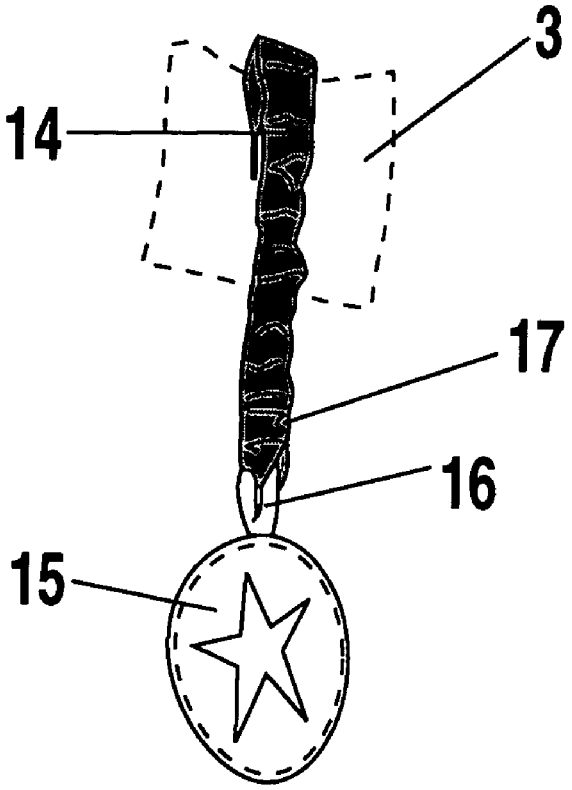
FIG. 5 is a perspective of the vest version of clothing of a portion of a vest pocket with a toy strap attached. This further demonstrates how the button at the top of the strap is pushed through the button hole (18) and secured to the inside of the vest.
Figure 6:
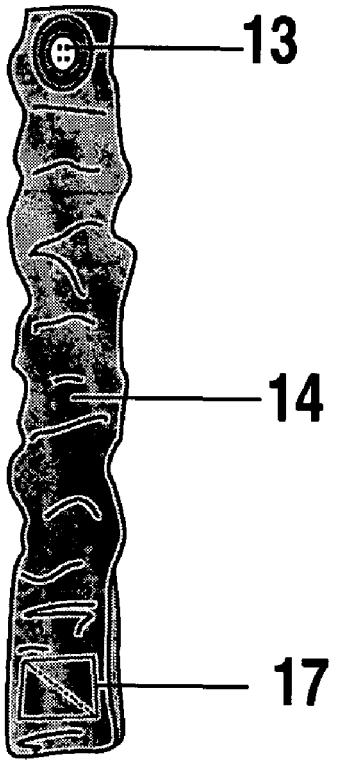
FIG. 6 is a perspective view of the vest version of clothing of a vest strap (14). The top of the strap has a button (13). The bottom of the strap has the fastener loop to secure toys (17).
Figure 7:
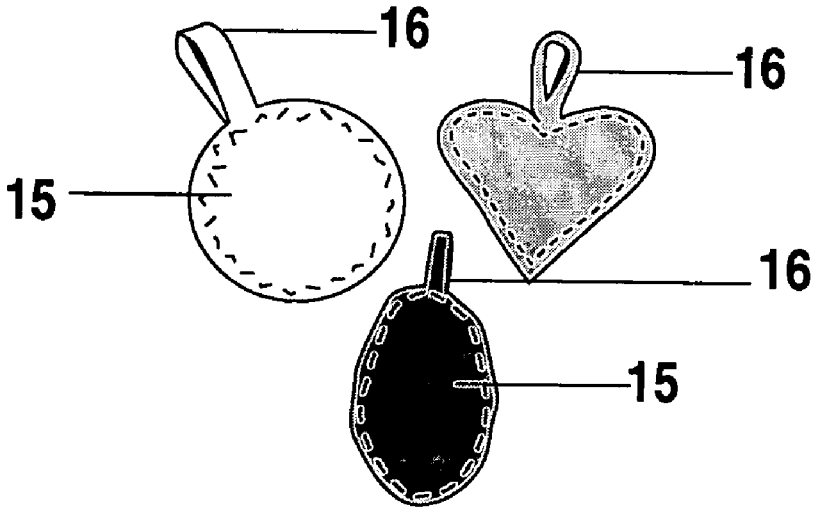
FIG. 7 is the front perspective view of the vest version of clothing of three of the toys (15) made for use with the vest, specifically the loop used for attaching toys to the vest strap.
Figure 8:
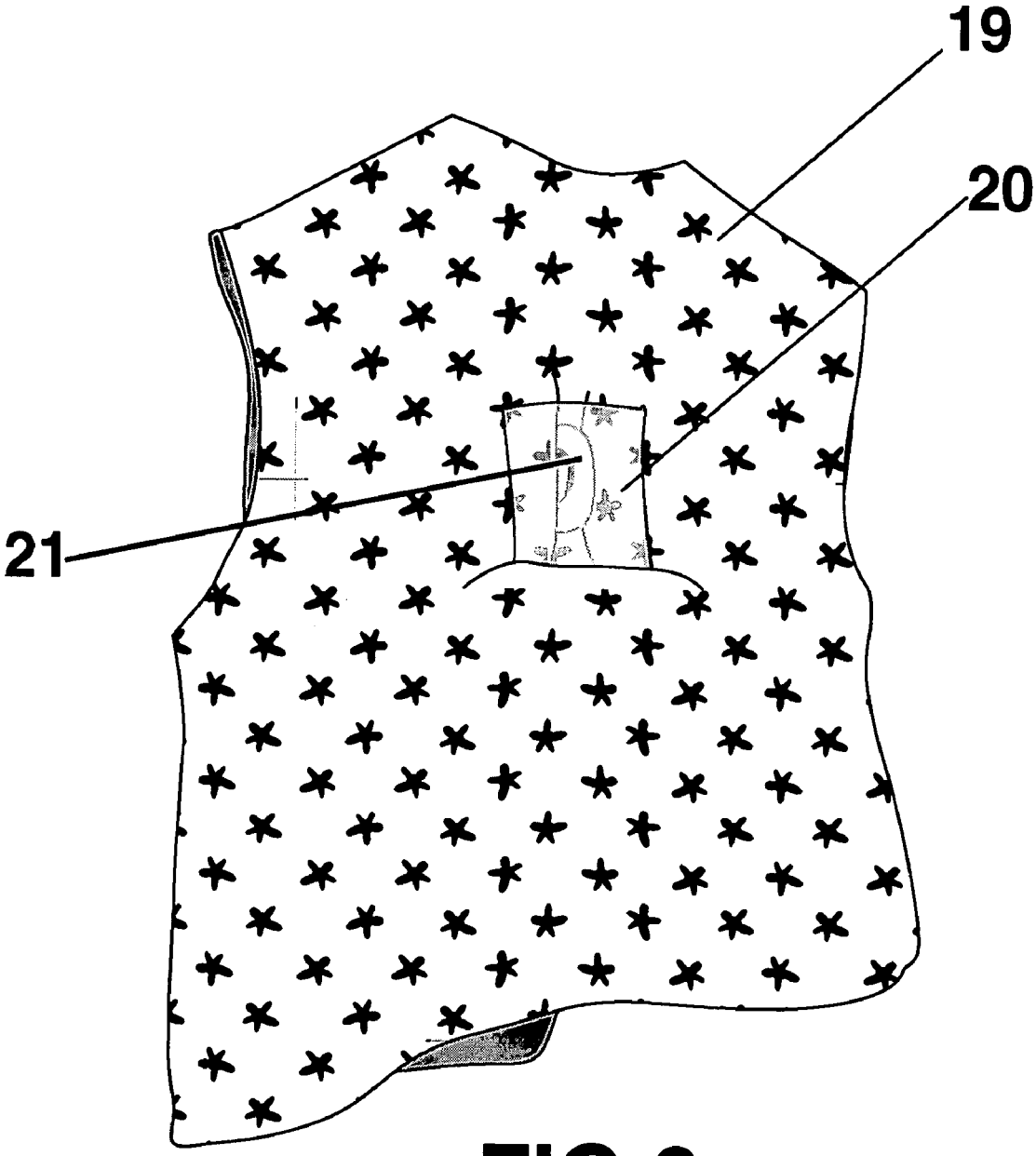
FIG. 8 is the perspective view of the vest version of clothing of the back of the vest (19), specifically a flap to cover (20) the loop (21) for securing a child-leash system. Use of the leash loop attachment is optional.

Removable toys may be included with the vest (FIG. 7). The removable toys may come in a variety of shapes and sizes, including triangle, square, oval, circle, rectangle and star. The toys may be covered with a soft material that is water-absorbent. The toys may contain a variety of sound-making items, including bells, shrink-wrap material, music boxes and animal sounds. The outside may be decorated in solid colors as well as embroidered materials. Each toy can be added by opening the fastening loop (FIG. 6) on the end of the strap and slipping the toy on to the loop. Each toy has a loop on the top to fit onto the fastening loop of the strap. (FIGS. 5 and 7)

The back of the vest may include a hidden tab for attaching a child leash system. This is hidden by a flap of material, so it is optional. This allows users to incorporate the vest with their existing child-leash system.

We claim:

1. An article of clothing designed to allow for fastening and removal of items of entertainment, worn on the upper portion on a person's body, comprising:

(a) a front side with at least one pocket on said front side, (b) at least one button hole behind said at least one pocket, and (c) at least one toy strap is secured beneath said at least one pocket by fitting a button on an upper portion thereof and into said at least one buttonhole, (d) at least one fastener on a bottom portion of said at least one toy strap secures at least one toy thereto.

2. The article of clothing of claim 1 further including a flap-covered loop for securing an existing child-leash system.

3. The article of clothing of claim 2 further including a reversible side comprising:

(a) a front side with at least one pocket on said front side, and (b) at least one buttonhole behind said at least one pocket.

4. The article of clothing of claim 1 further including a reversible side comprising:

(a) a front side with at least one pocket on said front side, and (b) at least one buttonhole behind said at least one pocket.

5. The article of clothing of claim 1 further including a means to close the clothing on the wearer.

6. The article of clothing of claim 5 wherein the means to close the clothing on the wearer is at least one button hole and corresponding loop.

* * * * *